United States Patent [19]

Manoogian et al.

[11] Patent Number: 5,055,697

[45] Date of Patent: Oct. 8, 1991

[54] INFRARED RADIATOR

[75] Inventors: Ara K. Manoogian, Los Angeles; J. Gary Rutberg, Glendale, both of Calif.

[73] Assignee: Electro-Mechanical Imagineering, Inc., Pacoima, Calif.

[21] Appl. No.: 573,088

[22] Filed: Aug. 24, 1990

[51] Int. Cl.[5] ..... H01J 61/52

[52] U.S. Cl. ..... 250/504 R; 362/293; 362/294; 362/373

[58] Field of Search ..... 250/504 R; 362/293, 362/294, 373

[56] References Cited

U.S. PATENT DOCUMENTS

| | | | |
|---|---|---|---|
| 4,321,659 | 3/1982 | Wheeler | 362/293 |
| 4,546,420 | 10/1985 | Wheeler et al. | 362/268 |
| 4,596,935 | 6/1986 | Lumpp | 250/504 R |
| 4,604,680 | 8/1986 | Levin et al. | 362/293 |
| 4,695,930 | 9/1987 | Wierzbicki et al. | 362/293 |
| 4,939,374 | 7/1990 | Greutert | 250/504 R |

*Primary Examiner*—Jack I. Berman

*Attorney, Agent, or Firm*—Nilsson, Robbins Dalgarn, Berliner Carson & Wurst

[57] ABSTRACT

A source of infrared radiation or an infrared radiator is disclosed for use in surveillance systems, and the like. The infrared radiator comprises a light source for providing a beam containing infrared radiation and a radiation filter disposed in the path of the beam to selectively pass only the infrared radiation. The light source and radiation filter are disposed within an inner housing which is in heat transfer proximity thereto. The inner housing is configured to contain visible light within the inner housing and permit infrared radiation to exit only through the radiation filter. An outer housing having openings formed therein is disposed about the inner housing such that a portion of the outer housing is spaced from the inner housing to define a path for air between the openings. In a preferred embodiment, a cooling means is located within the outer housing to force exterior air along the path, allowing heat absorbed by the inner housing to be dissipated. The infrared radiator is also designed to simplify routine service and maintenance procedures.

18 Claims, 3 Drawing Sheets

FIG. 3
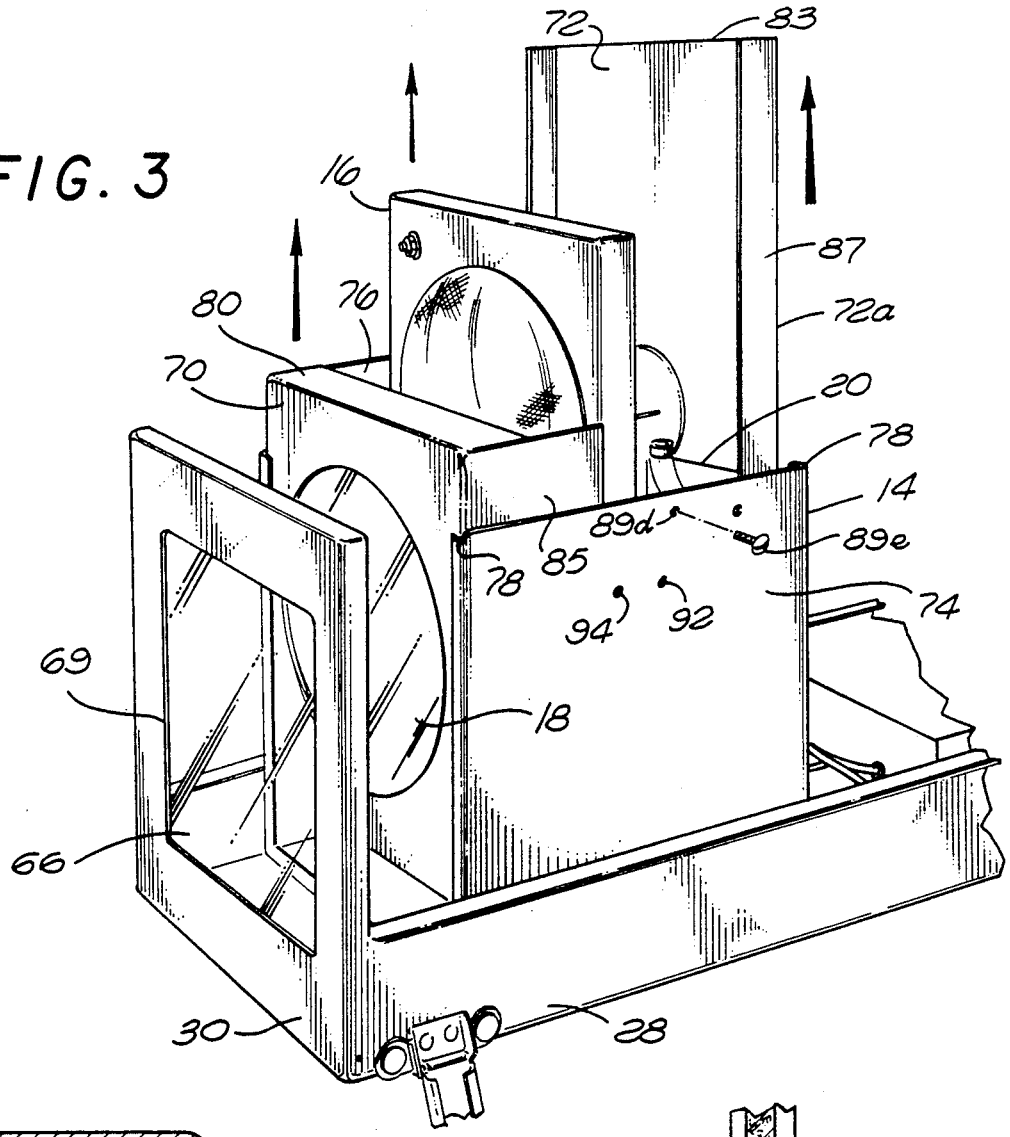
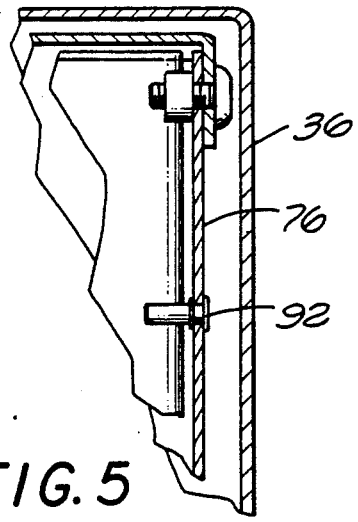
FIG. 5
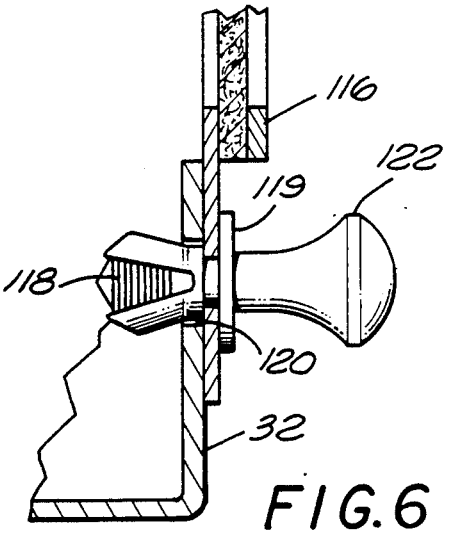
FIG. 6

INFRARED RADIATOR

FIELD OF THE INVENTION

The present invention relates generally to the field of infrared radiators. More specifically, the present invention relates to an infrared radiating illuminator.

BACKGROUND OF THE INVENTION

Surveillance systems, and the like, commonly utilize floodlights or illuminators, particularly at night, to illuminate areas under surveillance. Visible light is not always desirable because it can be seen with the unaided human eye. The term "illuminator" is often used to refer to a source of visible light; however, the term is used herein to refer to infrared radiators, as well. Infrared radiation is detectable with cameras and serves to illuminate the scene detected by the camera in the same way as visible light illuminates a scene to the human eye. For this reason, security systems have increasingly utilized infrared radiation to illuminate areas without signalling to those in the area that surveillance is taking place. Infrared radiation or illumination of this type is particularly advantageous when used with closed circuit television surveillance equipment. Conventional infrared floodlights of the lens or reflector type, typically utilize radiation filters located in front of the lens which absorb visible light and allow infrared radiation to pass.

Prior sources of infrared radiation operate at very high temperatures due to the amount of heat generated in the process. A significant amount of heat is absorbed by the radiation filters. A common problem with conventional infrared floodlights is that such devices typically overheat by absorbing heat not only in the filters, but also in the surrounding structure. In particular, lamps emitting a high proportion of infrared radiation are known to become exceptionally hot when confined within a small area such as a housing. It is important to operate these lamps near their recommended operating temperatures. Higher than optimum temperatures reduce their life span. Thus, heat must be effectively dissipated in order to ensure that the device performs satisfactorily.

In an attempt to overcome this problem, some form of cooling is generally required to dissipate heat generated by the lamp. A variety of systems have been proposed to do so in order to prevent thermal damage to system components and permit more convenient handling and use of the illuminator. One such system employs a cooling fan to draw filtered exterior air through an opening in the housing, pass the air directly over the lamp and allow the resulting warm air to exit through another opening.

Although prior cooling systems remove some heat, they have not been successful in keeping the housing of an infrared illuminator within acceptable temperature limits during extended use. The high temperatures reached by the housing and other portions of such devices continue to pose a problem and have proven to be a hazard, especially during routine service and maintenance procedures. Any contact with the housing causes burns and excruciating pain.

An additional disadvantage associated with conventional infrared floodlights is that openings formed in the housing to admit and discharge exterior air allow visible light to escape. Measures to prevent visible light from escaping have resulted in the housing being tightly sealed. One existing system employs a seal surrounding the entire device and is configured such that the components of the housing are interlocked with one another. This proves to be a severe hindrance when servicing the device. For example, it takes time to disassemble the device, and once serviced, it is difficult and time-consuming to make sure that the unit is completely sealed again.

A need thus exists for an infrared illuminator or a source of infrared radiation which is configured to effectively dissipate heat and prevent visible light from leaking out, and which is adapted to simplify routine service and maintenance procedures.

SUMMARY OF THE INVENTION

Briefly, the present invention is directed to a source of infrared radiation or an infrared illuminator for use in surveillance systems, and the like. In a preferred embodiment, the infrared illuminator comprises a light source for providing a beam containing infrared radiation and a radiation filter disposed in the path of the beam to selectively pass only the infrared radiation.

In one aspect of the invention the light source and the radiation filter are preferably enclosed within an inner housing which is in heat transfer proximity thereto. The inner housing is configured to be light-tight, i.e. to permit infrared radiation to exit the inner housing only through the radiation filter and to confine visible light within the inner housing.

In another aspect of the invention, an outer housing having openings formed therein is disposed about the inner housing such that a portion of the outer housing is spaced from the inner housing to define a path for air between the openings.

In yet another aspect of the present invention, cooling means forces exterior air along the path, allowing the heat absorbed by the inner housing to be effectively dissipated.

In still another aspect of the present invention, an air filter disposed adjacent the cooling means filters the exterior air before it is forced along the path.

In yet another aspect of the present invention, a dimmer connected to the light switch adjusts the intensity of the light source.

These, as well as other features of the invention, will become apparent from the detailed description which follows, considered together with the appended drawings.

BRIEF DESCRIPTION OF THE DRAWINGS

A preferred embodiment of the present invention is illustrated in and by the following drawings in which like reference numerals indicate like parts and in which:

FIG. 3 is an exploded view of an inner housing of the infrared illuminator of FIG. 1 illustrating the construction of the inner housing;

FIG. 5 is an enlarged cross-sectional view, taken along line 5—5 of FIG. 4, illustrating the manner in which a light source is slidably received in the inner housing; and FIG. 6 is an enlarged cross-sectional view, taken along line 6—6 of FIG. 4, illustrating the manner in which an air filter is engaged to an outer housing of the infrared illuminator.

DETAILED DESCRIPTION OF THE PREFERRED EMBODIMENT

Figure 1:
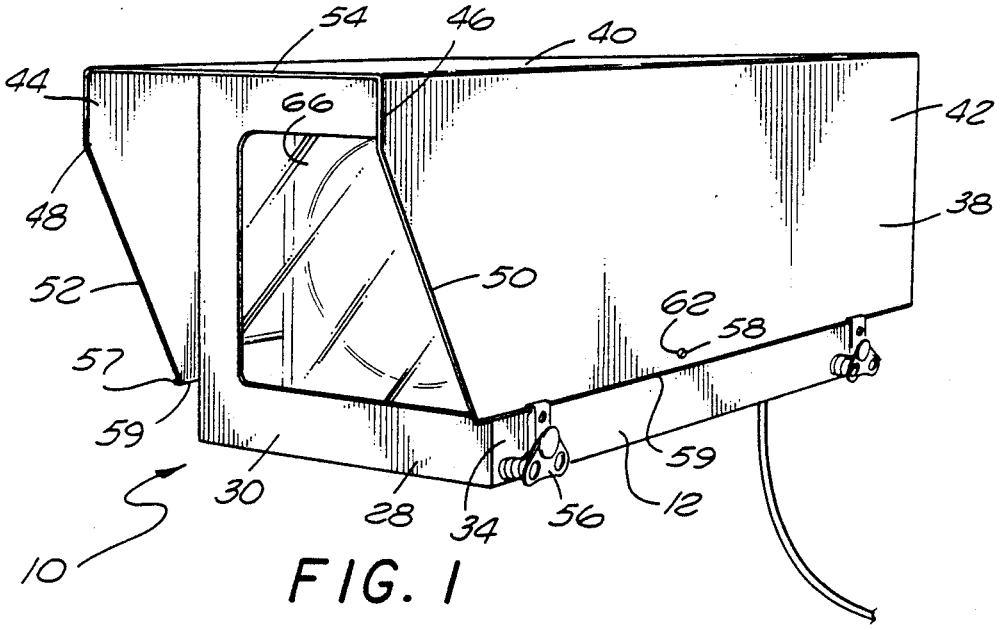
FIG. 1 is a perspective view of an infrared illuminator in accordance with a preferred embodiment of the present invention.

FIG. 1 illustrates generally a source of infrared radiation or an infrared illuminator 10 in accordance with a preferred embodiment of the present invention. The infrared illuminator 10 may be advantageously used in surveillance systems or the like, where it is desired to direct a beam of infrared radiation to illuminate a desired area. The infrared illuminator 10 is externally powered and may be mounted on a bracket at remote locations and used in conjunction with a closed circuit television surveillance system.

Figure 2:
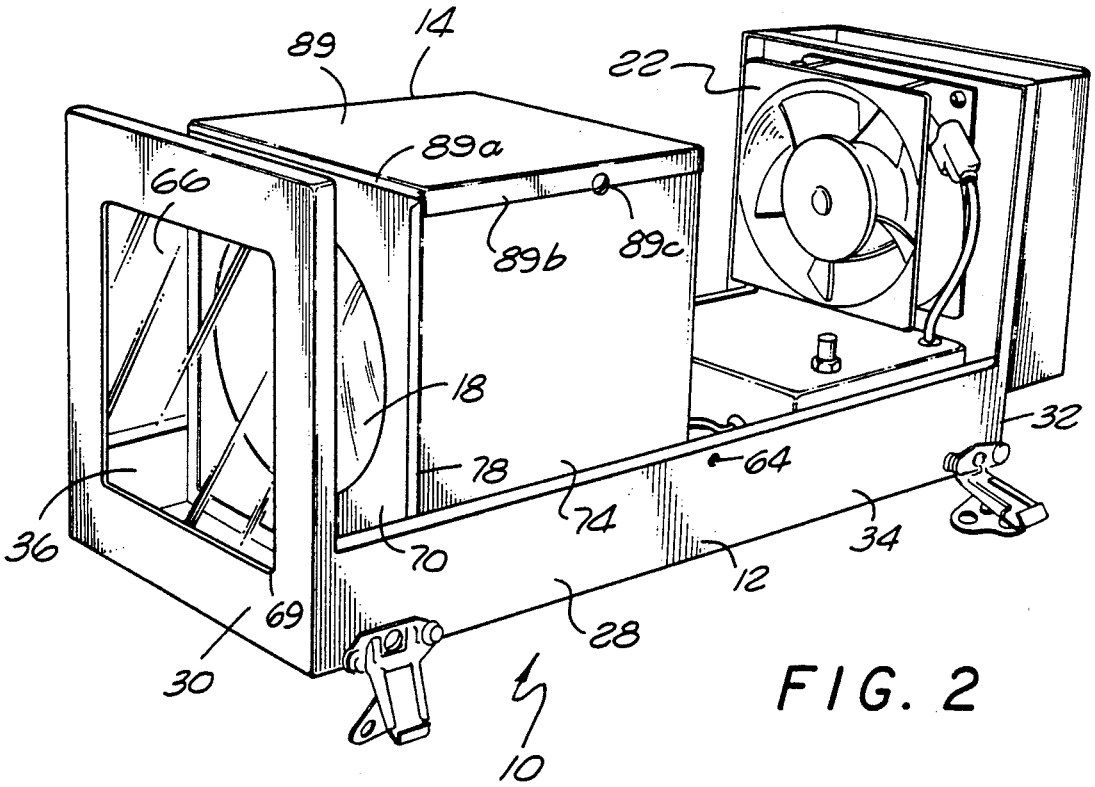
FIG. 2 is a side elevational view of a lower portion of the infrared illuminator of FIG. 1.

Referring to FIGS. 1 and 2, the infrared illuminator 10 in accordance with a preferred embodiment, comprises an outer housing 12 and an inner housing 14 disposed therein. A light source 16 (shown clearly in FIGS. 3 and 4) which emits a beam of infrared radiation is advantageously located within the inner housing 14. The beam of infrared radiation passes through a radiation filter 18 which is disposed in the path of the beam for selectively absorbing visible light and passing the infrared radiation emitted by the light source 16.

In a preferred embodiment of the present invention, the light source 16 and the radiation filter are disposed within a chamber 20 (shown in FIG. 3) defined by the inner housing 14. The inner housing 14 is preferably formed from a suitable heat conductive material. In an exemplary embodiment, the inner housing 14 is preferably formed from aluminum.

Advantageously, since the light source 16 is contained within the inner housing 14, a substantial amount of heat generated by the light source 16 is absorbed by the inner housing 14. The inner housing therefore acts as a heat sink. Heat absorbed by the inner housing 14 may be dissipated by convection or any suitable cooling means known in the art.

In an exemplary embodiment, a fan 22, of conventional design, is utilized. The fan 22 activates simultaneously with the infrared illuminator 10. The fan 22 draws exterior air into the outer housing 12 via a first opening 24 formed in the outer housing 12. The outer housing 14 comprises at least one opening 26 (best shown in FIG. 4) remote from the opening 24 to discharge the air.

The outer housing 12 is disposed about the inner housing 14 and is spaced therefrom by an amount sufficient to define an air path for exterior air to pass between the openings 24 and 26. Thus, the fan 22 draws in exterior air through the opening 24, passes the air about the inner housing 14 and along the air path, and forces the air out the second opening 26. In this fashion, exterior air passed between the two openings 24 and 26, respectively, dissipates the heat absorbed by the inner housing 14 and prevents the outer housing 12 from absorbing heat. Also, the inner housing 14 advantageously has a unique light-tight construction designed to confine all visible light within the inner housing 14, which will be described below in greater detail.

The light source 16 may preferably be of any commercially available type, for example, a tungsten lamp. In an exemplary embodiment, the bulb is preferably a "PAR-type" bulb, which is commercially available from sources such as Sylvania, GE and Phillips. Such bulbs are available in four sizes: "PAR 16", "PAR 46", "PAR 56" and "PAR 64", any of which may be used. The radiation filter 18 is preferably glass and has an infrared-transmissive coating thereon. In an exemplary embodiment, the filter is made of a suitable high temperature glass, such as that available commercially under the trademark "PYREX", and the coating is a multilayer dielectric coating, the purpose of which is to block visible light and transmit infrared radiation.

Referring now to FIG. 2 in more detail, the outer housing 12 has a lower portion 28 with front and rear walls 30 and 32, respectively, disposed at opposite ends. Opposing side walls 34 and 36 are disposed between the front and rear walls 30 and 32. In a preferred embodiment, the side walls 34 and 36 have a height significantly less than that of the front and rear walls 30 and 32. This facilitates servicing of the components located within the lower portion 28.

As shown in FIG. 1, the outer housing 12 also comprises a cover 38 having a roof 40 and cover side walls 42 and 44. The cover side walls 42 and 44, toward their front ends 46 and 48, respectively, terminate in inclined portions 50 and 52 which extend past the side extremity of the walls 34 and 36. The roof 40 terminates in a visor-like projection 54. The cover 38 is positioned over the lower portion 28 such that the inner periphery of each of the cover side walls 42 and 44, respectively, at their lower extremity, intimately contacts the outer periphery of each of the side walls 34 and 36, respectively.

Suitable fasteners 56, such as commercially available latches, may be used to engage a rolled edge 57 projecting from a lower peripheral edge 59 of the cover side walls 42 and 44 to secure the cover 38 over the lower portion 28. In an exemplary embodiment, the fasteners 56 are preferably spring latches, such as those available commercially from Simmons Latch Company of Chicago, Ill. Alternatively, other suitable latches may also be used to ensure that the cover 38 is held securely in place. To deter tampering, a pair of screws 58 are received through aligned apertures 62 and 64 formed in each of the cover side walls 42, 44, and each of the side walls 34 and 36, respectively.

Figure 4:
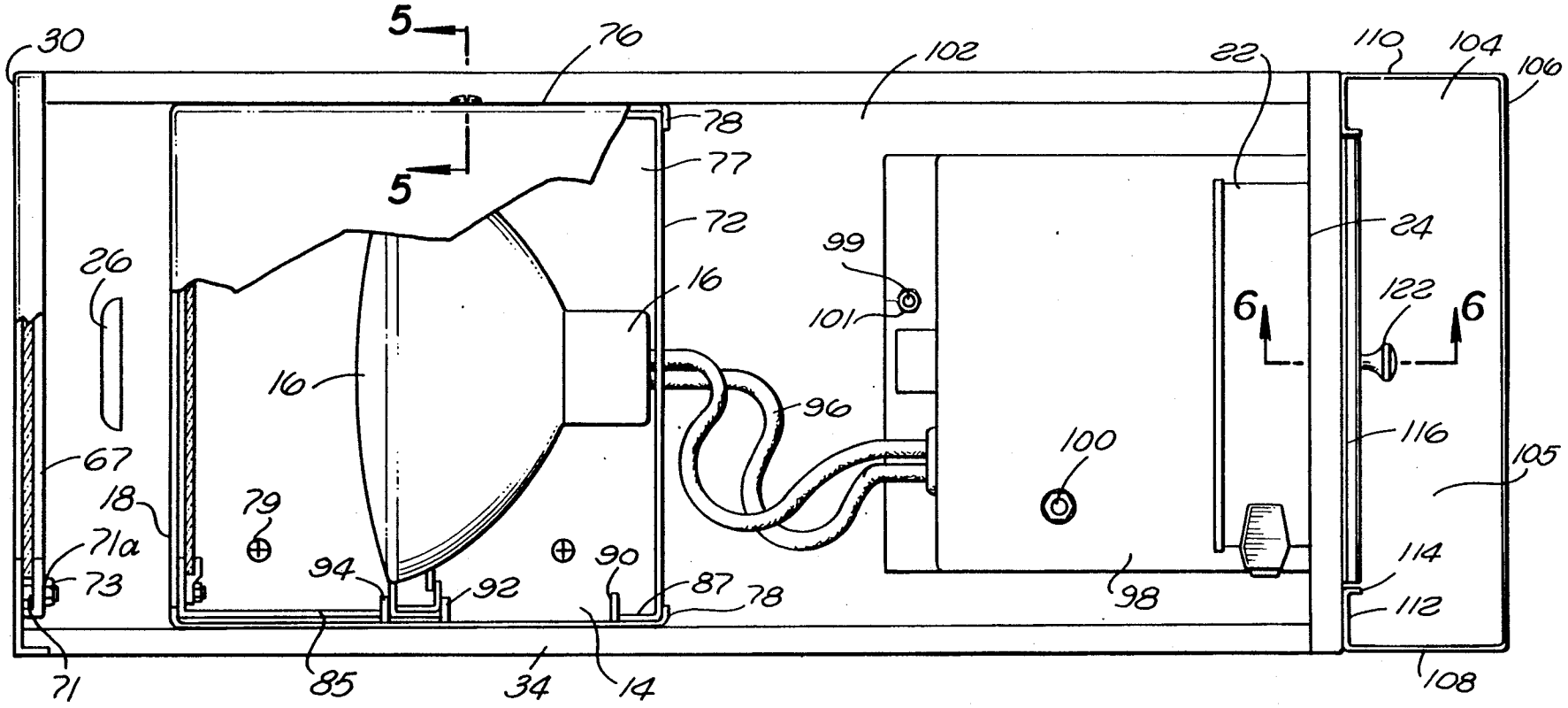
FIG. 4 is a plan view of the infrared illuminator.

The front wall 28 has a window means 66 centrally disposed therein. The window means 66 is preferably formed of glass or any such suitable transparent material. In the illustrated embodiment, the window 66 is rectangular in shape, however it may alternatively be of any other suitable configuration. As best shown in FIG. 4, the window 66 is held by a plurality of brackets 67 against a portion of the front wall 30 surrounding a window opening 69. Threaded studs 71 extend from the front wall 30 and through apertures 71*a* formed in the brackets 67. The brackets 67 are held against the front wall 30 by a plurality of nuts 73 to clamp the window 66 between the bracket 67 and the front wall 30.

Referring now to FIGS. 2, 3 and 4, the unique light-tight configuration of the inner housing 14 is described in greater detail. The inner housing 14 comprises four intersecting walls, a front wall 70, a rear wall 72 and opposing side walls 74 and 76. The inner housing 14 is mounted within the outer housing 12 such that a floor 77 of the inner housing 14 is spaced from the floor of the outer housing so as to define an air path. The floor 77 is mounted by four screws 99 at spaced locations. Likewise, the front wall 70, rear wall 72, and opposing side walls 74 and 76 of the inner housing 14 are also spaced from the front 30, rear 32 wall and side walls 34 and 36, respectively, of the outer housing 12 by an amount sufficient to define an air path.

Each of the side walls 74 and 76, at either end, terminates in a perpendicular lip portion 78 which overlaps side peripheral ends 70*a* and 72*a*, of the front and rear walls 70 and 72, respectively. The inner housing floor 77 terminates in a similar perpendicular lip portion along its front and rear peripheral ends, such that the lip portion (not shown) overlaps the lower extremity of the front and rear walls 70 and 72, respectively. The rounded corners of the lip portion 78 advantageously prevent visible light produced within the inner housing 14 from escaping.

The front and rear walls 70 and 72, respectively, at their upper ends have perpendicular flange portions 80 and 83 extending inward, the flange portion 80 extending further inward than the flange portion 83. The front and rear walls 70 and 72 also have side flange portions 85 and 87 extending inward at either side, the outer periphery of the flange portions 85 and 87 being in intimate contact with the inner periphery of the side walls 74 and 76.

An inner roof 89 of the inner housing 14 has a small perpendicular front projection 89*a* and perpendicular side extensions 89*b* which suitably fit over the four intersecting walls. The roof 89 is secured in position by a threaded screw 89*e* (best shown in FIG. 3) received through a semi-circular opening 89*c* in the side extension 89*b* and a threaded aperture 89*d* (best shown in FIG. 3) formed at the upper extremity of the side walls 74 and 76.

Referring now to FIGS. 4 and 5, each of the side walls 74 and 76 of the inner housing 14 has two spaced apart pins or studs 90 vertically aligned along a common plane spaced from the rear wall 72 such that the side flanges 87 of the rear wall 72 contact the studs 90. Thus, the rear wall is slidably received within an effective "channel" formed by the studs 90 and the lip portions 78 at the rear extremities of the side walls 74 and 76. Centrally disposed in the side walls 74 and 76 are two pairs of spaced apart pins 92 and 94 aligned vertically along two parallel planes. The light source 16 is slidably received within a second effective channel formed by the pins 92 and 94. In a similar fashion, the front wall 30 is slidably received between the lip portions 78 at the front extremity of the side walls 74 and 76 and the pair of pins 92, such that the flange 85 contacts the pin 94. In this manner, the front wall 28 having the radiation filter 18 disposed therein, the light source 16 and/or the rear wall 72 may be easily removed by slidably lifting them out in the direction of the arrows of FIG. 3, and advantageously replaced just as easily.

Referring now to FIGS. 4 and 6, the light source 16 is electrically connected by wires 96 to a dimmer circuitry (not shown), of conventional design, located within a housing 98. A dimmer switch 100, connected to the dimmer circuitry and located on the housing 98, may be manually controlled to vary the intensity. The housing 98 is secured to an outer housing floor 102 by a threaded stud 99 extending therefrom and a nut 101. The housing 98 also contains additional support circuitry such as a circuit breaker, photoelectric switch and thermostat.

Proximate the outer opening 26, a rear wall projection 104 is secured to the rear wall 32 (FIG. 4). The rear wall projection 104 comprise a rear wall 106 and side walls 108 and 110, having a portion 112 thereof which lies parallel to and in intimate contact with the rear wall 32 of the outer housing 12. The portion 112 is secured to the rear wall 32 by threaded shafts extending through apertures formed in the portion 112 and the rear wall 72 to engage a plurality of nuts. In a preferred embodiment, the rear wall projection 104 forms a hollow opening 105 therebetween, suitably sized to receive a person's hand.

Disposed between curved ends 114 of the portion 112 is an air filter 116 which advantageously filters exterior air before it is drawn through the opening 26. The air filter 116, of conventional design, is affixed to the rear wall 32 of the outer housing 12 by a releasable connector 118 extending through apertures 119 and 120, respectively, formed in the air filter and the rear wall 32. A handle 122 of the connector 118 can be pulled out to release the connector so that the air filter 116 may be easily removed for cleaning or replacement.

Although the invention has been described in terms of a preferred embodiment thereof, other embodiments that are apparent to those of ordinary skill in the art are also within the scope of the invention. Accordingly, the scope of the invention is intended to be defined only by reference to the appended claims.

What is claimed is:

1. A source of infrared radiation, comprising:

a light source providing a beam containing infrared radiation;

radiation filter means disposed in the path of said beam to selectively pass infrared radiation;

an inner housing defining a chamber therein, said light source and said radiation filter means disposed within said inner housing in heat transfer proximity thereto, said inner housing permitting radiation to exit only through said radiation filter means; and an outer housing having first and second openings, said outer housing disposed about said inner housing and having a portion spaced therefrom to define a path for air between said first and second openings.

2. A source of infrared radiation, comprising:

a light source providing a beam containing infrared radiation;

radiation filter means disposed in the path of said beam to selectively pass infrared radiation;

an inner housing defining a chamber therein, said light source and said radiation filter means disposed within said inner housing in heat transfer proximity thereto, said inner housing permitting radiation to exit only through said radiation filter means;

an outer housing having first and second openings, said outer housing disposed about said inner housing and having a portion spaced therefrom to define a path for air between said first and second openings; and cooling means for forcing exterior air along said path between said first and second openings.

3. A source of infrared radiation as defined in claim 2, wherein said outer housing has a window means, said window means permitting infrared radiation provided by said filter means to exit the outer housing.

4. A source of infrared radiation as defined in claim 2, wherein said inner housing comprises four intersecting walls, said intersecting walls forming corners configured to prevent visible light from escaping.

5. A source of infrared radiation as defined in claim 4, wherein two of said intersecting walls, at either end terminate in a perpendicular lip portion, said perpendicular lip portion overlapping an end portion of said other two intersecting walls.

6. A source of infrared radiation as defined in claim 5, wherein said other two intersecting walls terminate in a perpendicular flange portion configured to prevent visible light from escaping.

7. A source of infrared radiation as defined in claim 6, wherein said inner housing further comprises a cover, said cover overlapping an upper end portion of each of said four intersecting walls.

8. A source of infrared radiation as defined in claim 2, wherein said light source and said filter are releasably engaged with said inner housing.

9. A source of infrared radiation as defined in claim 2, wherein said inner housing slidably receives said light source.

10. A source of infrared radiation as defined in claim 9, wherein said inner housing includes a plurality of pins aligned to slidably receive said light source.

11. A source of infrared radiation as defined in claim 2, further comprising:

air filter means disposed adjacent said cooling means for filtering the exterior air drawn into said outer housing.

12. A source of infrared radiation as defined in claim 11, wherein said air filter means is releasably engaged to said outer housing.

13. A source of infrared radiation as defined in claim 2, further comprising:

a dimmer switch connected to said light source for adjusting the intensity of said light source.

14. A source of infrared radiation as defined in claim 2, wherein said inner housing is formed from heat conductive material.

15. A source of infrared radiation as defined in claim 2, wherein said light source is a tungsten lamp.

16. A source of infrared radiation as defined in claim 2, wherein said radiation filter means has a multilayer dielectric coating thereon.

17. A source of infrared radiation, comprising:

an inner housing adapted to contain light and to dissipate heat, further comprising:

a light source providing a beam containing infrared radiation; and radiation filter means disposed adjacent said light source, said radiation filter means selectively absorbing visible light and passing infrared radiation emitted by said light source;

an outer housing disposed about said inner housing and having a portion spaced therefrom to define a path for cooling air;

cooling means located at a first end of said outer housing to draw exterior air in through said first end and out through a second end of said outer housing; and air filter means disposed adjacent said cooling means for filtering the exterior air drawn into said outer housing.

18. A method for illuminating areas with infrared radiation, comprising the steps of:

providing a light source emitting a beam containing infrared radiation;

directing said beam through a filter means to absorb visible light and pass infrared radiation emitted by the light source;

containing visible light emitted by the light source within a light-tight housing;

directing infrared radiation passed by the radiation filter means into an area to be illuminated; and cooling said light-tight housing to dissipate heat absorbed by said light-tight housing from said light source by passing exterior air along a path formed by the space between the light-tight housing and a second, outer housing disposed thereabout.

* * * * *